US006397957B2

(12) United States Patent
Mocivnik et al.

(10) Patent No.: US 6,397,957 B2
(45) Date of Patent: Jun. 4, 2002

(54) JACKET TUBE FOR A DRILLING AND ANCHORING DEVICE

(75) Inventors: Josef Mocivnik, Fohnsdorf; Karl Bohm, Ansfelden, both of (AT)

(73) Assignees: Techmo Entwicklungs-und Vertriebs GmbH, Fohnsdorf; "ALWAG" Tunnelausbau Gesellschaft m.b.H., Pasching, both of (AT)

( * ) Notice: Subject to any disclaimer, the term of this patent is extended or adjusted under 35 U.S.C. 154(b) by 0 days.

(21) Appl. No.: 09/824,698

(22) Filed: Apr. 4, 2001

Related U.S. Application Data

(63) Continuation of application No. PCT/AT99/00237, filed on Oct. 4, 1999.

(30) Foreign Application Priority Data

Oct. 5, 1998 (AT) ..... 1659/98

(51) Int. Cl.[7] ..... E21B 33/138; E21D 21/00
(52) U.S. Cl. ..... 175/320; 175/306; 405/259.5
(58) Field of Search ..... 175/320, 340, 175/293, 300, 306; 405/259.5, 259.2, 259.3

(56) References Cited

U.S. PATENT DOCUMENTS

| | | | | | |
|---|---|---|---|---|---|
| 3,969,976 | A | * | 7/1976 | Amico | 85/75 |
| 4,007,797 | A | * | 2/1977 | Jeter | 175/26 |
| 4,516,883 | A | * | 5/1985 | Zeitler | 405/260 |
| 4,601,614 | A | * | 7/1986 | Lane et al. | 405/261 |
| 4,640,362 | A | * | 2/1987 | Schellstede | 166/298 |
| 4,954,017 | A | * | 9/1990 | Davis et al. | 405/259 |
| 6,199,633 | B1 | * | 3/2001 | Longbottom | 166/242.6 |

FOREIGN PATENT DOCUMENTS

| | | |
|---|---|---|
| DE | 2133593 | 7/1973 |
| DE | 2545572 | 4/1977 |
| DE | 4018703 C1 | 8/1991 |
| DE | 19503122 A1 | 8/1996 |
| WO | WO98/21439 | 5/1998 |

* cited by examiner

*Primary Examiner*—Frank Tsay
(74) *Attorney, Agent, or Firm*—Jacobson Holman, PLLC

(57) ABSTRACT

A jacket tube for a device for drilling holes and forming an anchorage in the earth or rock. The jacket tube is coupled with a drill pipe and/or a drill bit or a drill hammer and is configured with a plurality of through openings across its periphery. Once the borehole has been made, or after an anchor has been introduced, the jacket tube can be filled with a hardenable suspension. The jacket tube consists of at least one expanded metal element which has evenly distributed through openings and connecting elements, especially sleeves, at the ends for connecting to a drill bit and/or other jacket tube elements. The borehole is therefore easy to produce and the jacket tube can be anchored securely.

10 Claims, 3 Drawing Sheets

JACKET TUBE FOR A DRILLING AND ANCHORING DEVICE

The present invention is a continuation application of PCT/AT99/00237, filed Oct. 4, 1999.

FIELD OF THE INVENTION

The present invention relates to a jacket tube for a device for drilling holes and forming an anchorage in soil or rock material, wherein the jacket tube is coupled with a drill rod assembly and/or a drill bit or a drilling hammer, respectively, and is formed with a plurality of passage openings about its circumference and capable of being filled with a curable suspension after completion of the drill hole or after insertion of a roof bolt.

DESCRIPTION OF THE PRIOR ART

Devices for drilling and, in particular, impact drilling or rotary percussion drilling and subsequently lining holes in soil or rock material are known in various configurations. Thereby, a hole or a bore optionally extending over a great length is formed by the aid of a drill bit mounted on a drill rod assembly, the drill hole being formed by a percussive and/or rotary movement. In order to prevent material from breaking into the drill hole optionally extending over a great length and/or be able to provide a lining after completion of the bore, it was, for instance, proposed to use a jacket tube surrounding the drill rod assembly, which is introduced during the drilling procedure.

After completion of the bore, an anchor or roof bolt may, for instance, be inserted into the jacket tube or the drill rod assembly may directly be employed as an anchoring means and a rapidly setting suspension may be introduced for strengthening the surrounding material.

A device comprising a jacket tube of the initially defined type may be taken, for instance, from WO 98/21439, in which a process and a device for drilling and lining holes is disclosed. By means of a jacket tube that surrounds a drill rod assembly actuating a drill bit, an annular space is provided between the jacket tube and the external periphery of the drill rod assembly, wherein, for instance, in the region following immediately upon the drill bit, at least one passage opening is provided in the substantially solid jacket tube, via which passage opening worked material can optionally be removed from the drill hole to be produced and a curable suspension can be discharged into the surrounding material for forming an anchorage.

Instead of introducing a jacket tube along with the formation of the drill hole, methods have, moreover, become known in which, after completion of the drill hole, the drill bit is removed from the drill hole and a lining or jacket tube is subsequently inserted into the drill hole in a time-consuming multiple-step operation. Jacket tubes or sleeve-like inserts for such linings of drill holes may, for instance, be taken from DE-B 21 33 593, AT-B 329 487 or AT-B 262 196. It is apparent that such a mode of procedure is applicable only in those cases in which the breaking in of material into the finished drill hole can be excluded for sure, wherein, in addition, an accordingly enlarged cross section must be drilled in order to enable the subsequent insertion of the lining or jacket tube. In order to be able to insert such a lining or jacket tube of great length, that tube, in turn, must have a relatively large wall thickness in order to enable its safe insertion such that a drill bit having a relatively large diameter adapted to the dimensions of the jacket tube must be employed.

For the proper anchorage of a roof bolt as well as the jacket tube surrounding the roof bolt after ejection of a curable suspension, an accordingly stable connection with the surrounding material is, however, additionally required in order to be able to reliably avoid any unintentional removal of the roof bolt under an accordingly high load. In this context, the known embodiments of jacket tubes such as, for instance, of WO 98/21439 involve the drawback that they have substantially smooth surfaces, being usually made of steel or synthetic elements, such that even upon introduction of a suspension through a plurality of passage openings provided in the jacket tube a partially only local penetration of the curable suspension into the surrounding material is rendered feasible and a substantially smooth or plane interface will be obtained between the suspension and the external surfaces of the jacket tube, thus partially strongly impairing the anchoring effect, in particular in the region of the jacket tube.

SUMMARY OF THE INVENTION

The present invention aims at providing a jacket tube of the initially defined kind, wherein, in addition to the rapid and simple lining of a drill hole by simultaneously inserting a jacket tube, a reliable anchorage or additional reinforcement of a roof bolt to be inserted into the jacket tube, or of a drill rod assembly employed as a roof bolt, will be obtained subsequently by introducing a curable suspension discharged at least partially into the material surrounding the drill hole with the jacket tube being securely anchored. To solve these objects, the jacket tube according to the invention is essentially characterized in that the jacket tube is formed of at least one expanded metal element provided with uniformly distributed passage openings and comprising, on its ends, connecting elements, in particular sleeves, for connection with the drill bit and/or further jacket tube elements. Due to the fact that, according to the invention, the jacket tube is formed of at least one expanded metal element which is provided with a plurality of passage openings uniformly distributed about its circumference, the large-surface discharge of the curable suspension into the surrounding material after completion of the drill hole for setting a roof bolt is safely feasible such that an accordingly safe anchorage of the roof bolt and of the jacket tube will be obtained. In addition, the design of the jacket tube with at least one expanded metal element ensures that the jacket tube does not have a completely plane, smooth external surface so that, upon introduction of the curable suspension, the anchoring effect within the surrounding material after curing of the suspension will be accordingly enhanced due to the inherent surface structure of the expanded metal element or inherent roughness of the surfaces of the expanded metal element. If bores extending over major lengths are provided, a jacket tube that is subdivided over its longitudinal extension will be employed in a manner known per se such that several consecutively arranged expanded metal elements will each be mutually connected by suitable connecting elements or immediately join the drill bit. By using an expanded metal element having an appropriate number of passage openings, a high elasticity of the jacket tube may be ensured by the insertion of the jacket tube during the drilling procedure such that the drilling procedure will not be hampered and a force distribution over the entire jacket tube will be obtained. Furthermore, after casting of a curable suspension, an additional armoring effect covering the total length of the jacket tube may be obtained by the expanded metal upon safe anchorage within the surrounding material via the rough surface such that the jacket tube and the roof bolt optionally received therein will fit closely after solidification, wherein, due to the enhancement of the anchoring or reinforcing effect by the expanded metal, it may in some cases be feasible to do with less heavily dimensioned roof bolts and hence optionally smaller dimensioned drill holes, which, in turn, leads to material saving and reduced drilling work.

In order to obtain a large passage cross section for the curable suspension as well as for an accordingly good anchoring effect, it is provided according to a preferred embodiment that the passage openings of the expanded metal element have substantially rhomboidal or lozenged contours. By such rhomboidal or lozenged contours of the passage openings, it is additionally ensured during the drilling procedure that the passage openings will not be completely obstructed and blocked by worked material, which, as a rule, has a substantially rounded or spherical shape. In this context, it is moreover contemplated in a particularly preferred manner that the expanded metal element has a grid-like or wire netting-like structure, from which an accordingly large clear passage area relative to the material cross section remaining between the individual passage openings and a high elasticity during introduction under the simultaneous achievement of an enhanced reinforcement and anchoring effect upon casting and curing of the suspension result.

In order to provide for proper guidance of the jacket tube comprised of at least one expanded metal element relative to the drill rod assembly or a roof bolt to be set subsequently, it is proposed that an annular space is defined by spacers arranged between the jacket tube and the drill rod assembly or roof bolt, respectively, in particular sleeve elements provided in the end regions of the expanded metal element(s), as in correspondence with a further preferred embodiment of the device according to the invention.

While the use of an expanded metal element for the formation of a jacket tube allows for the realization of accordingly large passage cross sections for curable material to be introduced subsequently and the achievement of an appropriate reinforcement and anchoring effect, the plurality of passage openings in some cases may bear the risk of water or moisture penetrating from the surrounding material into the region of the roof bolt, which may cause damage to the roof bolt by corrosion if the roof bolt remains within the drill hole, for instance, for several years. In order to provide for an additional protection against the penetration of moisture to the roof bolt, it is, therefore, proposed according to another preferred embodiment of the invention that the jacket tube is designed in several layers with a synthetic tube being provided between expanded metal elements designed with passage openings and arranged on the inner and outer surfaces, viewed in the radial direction. Due to that sandwich construction proposed according to the invention in a preferred manner and comprised of externally arranged expanded metal elements and an intermediate synthetic tube, the properties of the expanded metal element that are decisive for the enhanced anchoring effect can be utilized while largely minimizing the penetration of moisture towards the roof bolt, and hence the risk of corrosion, via the synthetic tube. For discharging a suspension aimed at subsequent anchoring, the synthetic tube must, of course, be provided with suitable passage openings, wherein, in this context, it is contemplated in a particularly preferred manner that the synthetic tube is designed with a plurality of outlet openings opening and closeable merely in the direction towards the outer side of the jacket tube such that the reliable discharging of the curable suspension into the surrounding region is ensured by such closeable outlet openings or openings opening by virtue of a valve effect merely in the direction outwards of the drill hole while avoiding the penetration of moisture. In that manner, an accordingly safe anchorage may again be obtained in the surrounding material, which, for instance, is formed by what is called overlay rock or loose rock, wherein, after curing of the suspension, the inherent roughness of the expanded metal elements again ensure an accordingly good anchoring effect and, at the same time, a sealing against possibly present moisture by means of the synthetic tube.

In particular with a jacket tube comprised of a multilayer sandwich structure, it is proposed according to another preferred embodiment relating to the connecting elements or sleeves that the connecting elements formed by sleeves have stepped contours or contours formed with offset regions, on which the internally and externally arranged expanded metal elements and the intermediate synthetic tube are fixable.

In order to enable the, in particular multilayer, jacket tube to be readily entrained during the drilling procedure, thereby providing an appropriate protective effect for the drill rod assembly already during the drilling procedure, it is, moreover, provided in a preferred manner that the jacket tube under tensile actuation is capable of being coupled with the drill bit, optionally by interposing a coupling element, in particular an impact shoe acting on the drill bit.

SHORT DESCRIPTION OF THE DRAWINGS

In the following, the invention will be explained in more detail by way of exemplary embodiments schematically illustrated in the annexed drawing. Therein:

DESCRIPTION OF PREFERRED EMBODIMENTS

Figure 1:
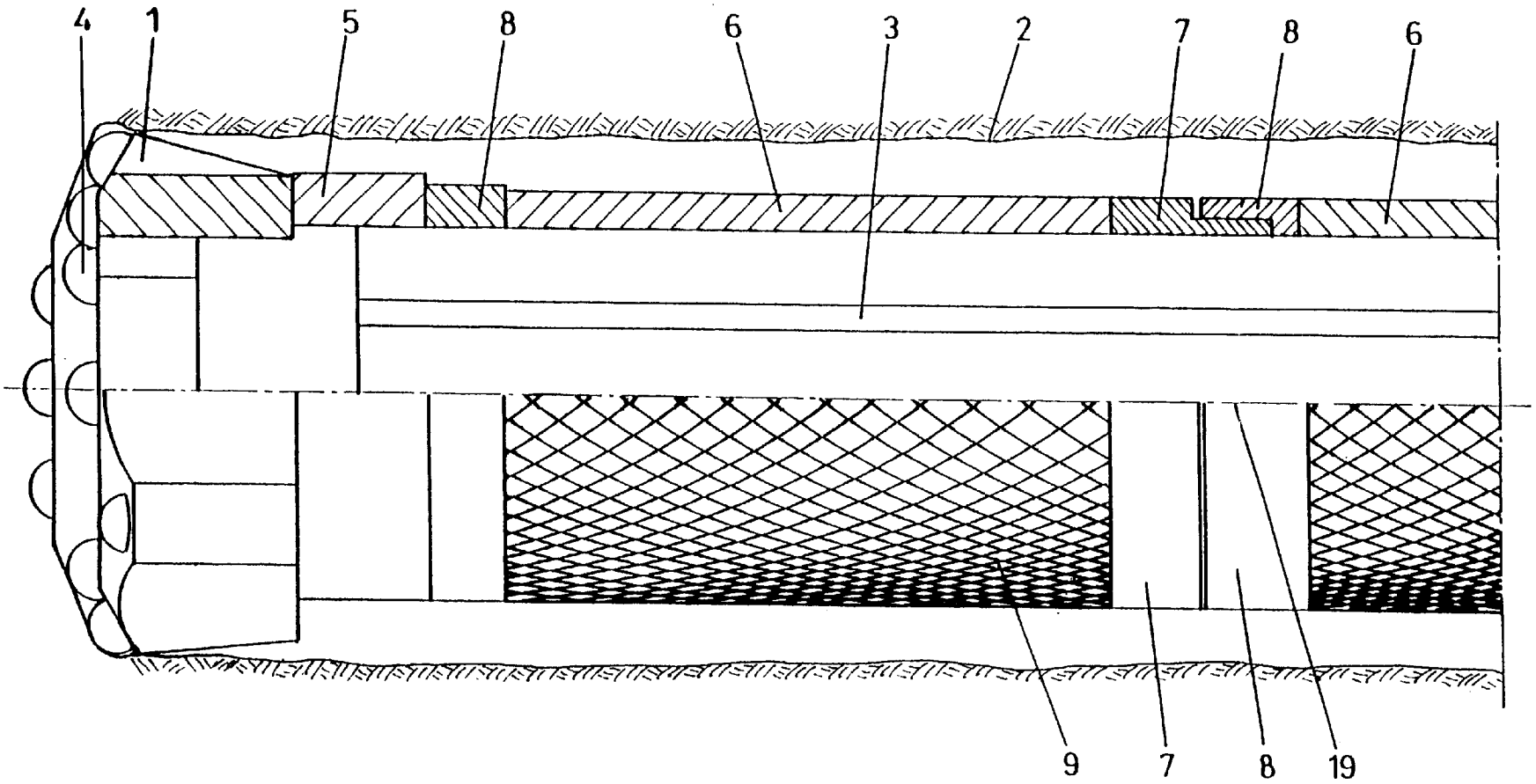
FIG. 1 is a partially sectioned schematic side view of a jacket tube according to the invention for a device for drilling with parts of the drilling device being indicated in addition.
Figure 2:
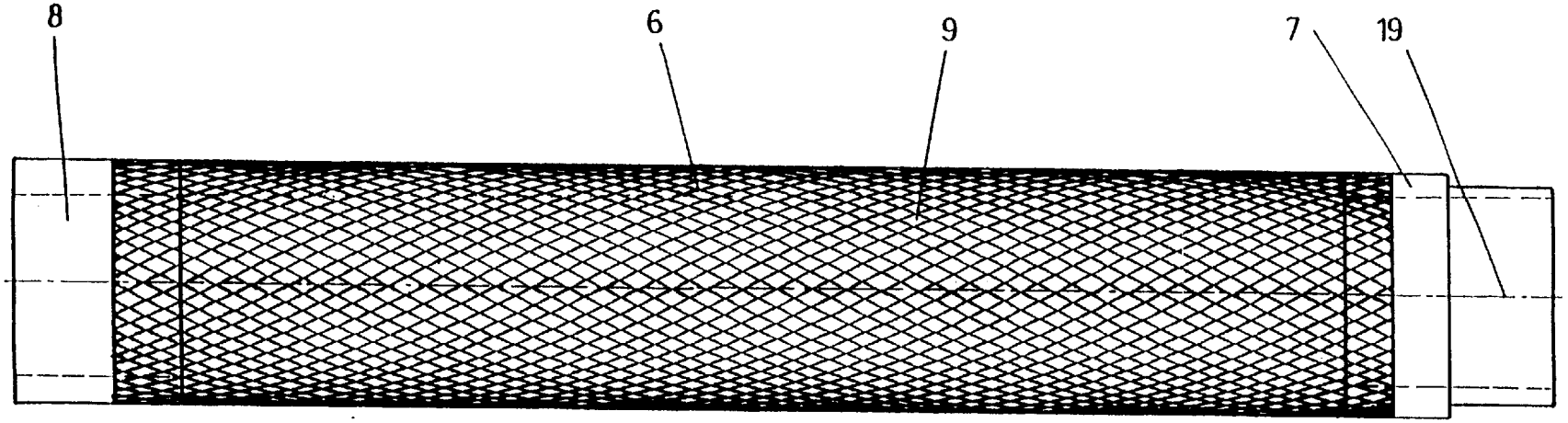
FIG. 2 is a side view of a jacket tube according to the invention produced of an expanded metal element.

FIG. 1 schematically depicts a drill bit 1 for forming a drill hole whose outer contour is indicated by 2, a schematically indicated drill rod assembly 3 being used for actuating the drill bit 1. Immediately with the drill bit 1 on the side facing away from the drilling elements 4, or the impact shoe 5 of the drill bit 1, is provided a jacket tube 6, wherein the jacket tube 6, as is particularly clearly apparent from FIG. 2, is comprised of expanded metal elements which, on their end regions, are each designed with sleeve elements 7 and 8 for connection with the drill bit 1, or impact shoe 5, as well as adjacent jacket tube elements 6. The sleeve elements 7, 8 may be designed with a view to obtaining an appropriate plug-in or screw connection in order to enable the appropriate extension of the jacket tube 6 similar to the extension of the drill rod assembly 3, in particular in case of a large-dimensional drill hole.

Such a jacket tube or expanded metal element 6 is clearly illustrated a second time in FIG. 2, wherein it is apparent that the passage openings uniformly distributed about the circumference of the jacket tube 6 formed by the expanded metal element each have substantially rhomboidal or lozenged contours 9 resulting in an altogether grid-shaped or mesh-like structure of the surface of the jacket tube 6.

After completion of the bore 2, either the drill rod assembly 3 is used directly as an anchor or roof bolt or a separate roof bolt is inserted into the completed bore 2 and into the interior of the jacket tube 6 after removal of the drill rod assembly 3 with at least parts of the drill bit 1, whereupon a curable suspension is introduced into the interior of the jacket tube 6, which is able to emerge into the surrounding material through the passage openings 9 formed in the expanded metal element 6. After curing of the suspension, an extremely resistant anchorage has been realized in the completed drill hole 2, the anchoring effect being supported, in particular, by the not completely plane surface structure of the expanded metal element 6 enabling an accordingly secure anchorage even of the jacket tube 6 by developing an additional reinforcement effect besides the anchorage of the roof bolt in the hardened suspension.

Figure 3:
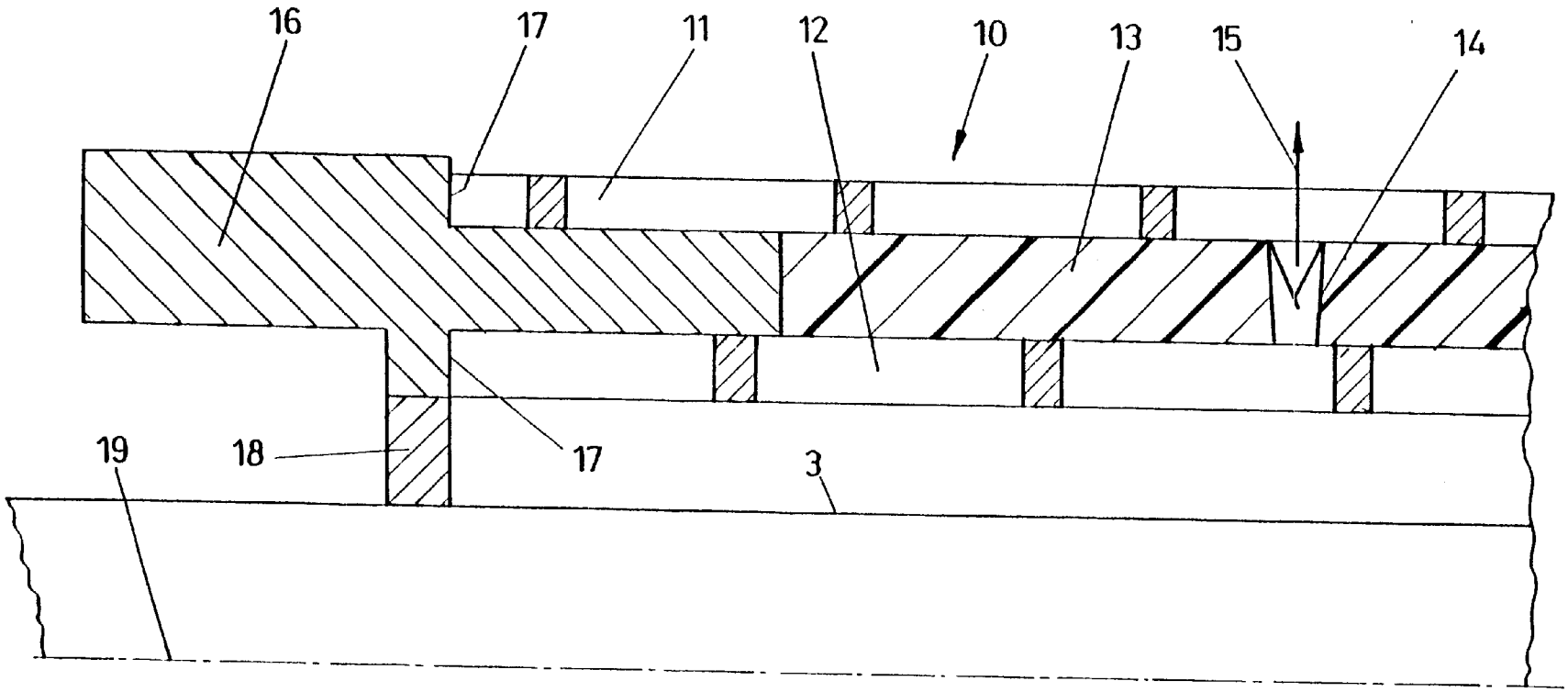
FIG. 3 on an enlarged scale shows a partial section through a modified embodiment of a multilayer jacket tube according to the invention.

FIG. 3 on an enlarged scale shows a partial section through a modified embodiment of a jacket tube schematically indicated by 10, the multilayer jacket tube 10 being formed by an externally arranged expanded metal element 11 again provided with a plurality of openings, an internally arranged expanded metal element 12 provided with openings, and an intermediately provided synthetic tube or element 13. The expanded metal elements 11 and 12 again are configured or made in a manner similar to the expanded metal element 6 illustrated in FIGS. 1 and 2, comprising a plurality of rhomboidal or lozenged passage openings 9. By contrast, the intermediately arranged synthetic tube 13 is designed to have a reduced number of passage openings, wherein FIG. 3 depicts one of the openings 14, which, in the sense of a valve effect, enables the passage of a suspension to be discharged subsequently merely in the direction indicated by the arrow 15. In the embodiment illustrated in FIG. 3, it is thus ensured that after the introduction of a suspension for the formation of an anchorage no moisture or water may enter from the surrounding material in the direction towards the drill rod assembly 3 or a roof bolt to be placed instead of the drill rod assembly 3, thus avoiding the effect of corrosion and allowing the production of roof bolts that are capable of remaining within the drill hole for a great number of years.

In the embodiment illustrated in FIG. 3 of the jacket tube 10, a modified embodiment of a sleeve 16 including offset or stepped regions 17 is used in order to enable the fixation of the individual layers or elements 11, 12 and 13 for the formation of the sandwich structure of the jacket tube 10. Moreover, an additional spacer or projection of the sleeve element 18 is indicated in FIG. 3 in order to enable appropriate positioning relative to the drill rod assembly 3 or a roof bolt to be set, the central line of the overall construction each being indicated by 19 in all of the Figures.

What is claimed is:

1. A jacket tube for a device for drilling holes and forming an anchorage in soil or rock material, wherein the jacket tube is coupled with a drill rod assembly and/or a drill bit or a drilling hammer, respectively, and is formed with a plurality of passage openings about its circumference and capable of being filled with a curable suspension after completion of the drill hole or after insertion of a roof bolt, wherein the jacket tube is formed of at least one expanded metal element provided with uniformly distributed passage openings and comprising, on its ends, connecting elements, in particular sleeves, for connection with the drill bit and/or further jacket tube elements.

2. A jacket tube according to claim 1, wherein the passage openings of the expanded metal element have substantially rhomboidal or lozenged contours.

3. A jacket tube according to claim 1, wherein the expanded metal element has a grid-like or wire netting-like structure.

4. A jacket tube according to claim 1, wherein an annular space is defined by spacers arranged between the jacket tube and the drill rod assembly or roof bolt, respectively.

5. A jacket tube according to claim 4, wherein the spacers are sleeve elements provided in the ends of the at least one expanded metal element.

6. A jacket tube according to claim 1, wherein the jacket tube includes layers with a synthetic tube being provided between expanded metal elements having passage openings and arranged on inner and outer surfaces, viewed in a radial direction.

7. A jacket tube according to claim 6, wherein the synthetic tube is designed with a plurality of outlet openings and closeable merely in a direction towards the outer side of te jacket tube.

8. A jacket tube according to claim 6, wherein the connecting elements formed by sleeves have stepped contours or contours formed with offset regions, on which internally and externally arranged expanded metal elements and the intermediate synthetic tube are fixable.

9. A jacket tube according to claim 1, wherein the jacket tube is capable of being coupled with the drill bit or the drilling hammer, respectively, by interposing a coupling element acting on the drill bit.

10. A jacket tube according to claim 9, wherein the coupling element is an impact shoe.

* * * * *